US005882226A

United States Patent [19]

Bell et al.

[11] Patent Number: 5,882,226

[45] Date of Patent: Mar. 16, 1999

[54] ELECTRICAL CONNECTOR AND CABLE TERMINATION SYSTEM

[75] Inventors: Jonathan David Bell, Ramsgate; Nicholas Mark Jones, Herne Bay, both of Great Britain

[73] Assignee: Amphenol Corporation, Wallingford, Conn.

[21] Appl. No.: 889,600

[22] Filed: Jul. 8, 1997

[30] Foreign Application Priority Data

Jul. 8, 1996 [GB] United Kingdom ..... 9614288

[51] Int. Cl.[6] ..... H01R 9/05

[52] U.S. Cl. ..... 439/582; 439/11

[58] Field of Search ..... 439/11, 162, 582, 439/610, 446, 578, 579, 580, 581, 583, 584, 585, 98, 99

[56] References Cited

U.S. PATENT DOCUMENTS

| | | | |
|---|---|---|---|
| 4,531,805 | 7/1985 | Warth | 339/143 |
| 4,741,702 | 5/1988 | Yasumoto | 439/578 |
| 5,277,590 | 1/1994 | Thomas et al. | 439/582 |

FOREIGN PATENT DOCUMENTS

| | | |
|---|---|---|
| 2 551 271 | 3/1985 | European Pat. Off. . |
| 0 190 843 | 8/1986 | European Pat. Off. . |
| 44 01 245 | 3/1995 | Germany . |
| 2 210 730 | 6/1989 | United Kingdom . |
| 2 228 630 | 8/1990 | United Kingdom . |

*Primary Examiner*—Gary F. Paumen
*Assistant Examiner*—Javaid H. Nasri
*Attorney, Agent, or Firm*—Bacon & Thomas

[57] ABSTRACT

An electrical connector and cable termination system has a plug body (12) for mating with an opposed connector part, and an outlet body (22) to which a cable (60) is attached. The cable approaches the connector at an angle of 90° to the major mating axis (C) of the connector. The outlet body and the plug body can be relatively rotated about the major axis of the connector. To this end, there is a retention ring (40) for inhibiting relative axial movement of the outlet body and the first connector body part, a key (50) and detent (54) for permitting relative rotation by at least 180° but inhibiting relative rotation in excess of 360°, and an O-ring (34) of conductive resilient material between the outlet body and the plug body and for providing a limited degree of frictional resistance to the relative rotation of the outlet body and the first connector body part.

9 Claims, 4 Drawing Sheets

ELECTRICAL CONNECTOR AND CABLE TERMINATION SYSTEM

This invention relates to electrical connectors, and in particular to a combined connector and cable termination system.

Combined connector and cable termination systems are available which allow the cable to leave the connector area at an angle to the mating axis of the connector portion. Typically this angle may be 90°. Furthermore the connector may depart at any given orientation relative to the mating connector axis, and different connector and cable terminations are provided for different orientations of departure of the cable relative to the connector portion.

We have appreciated that considerable economies would be obtained if a connector and cable termination system were available which allowed the orientation of the departure of the cable around the connector axis to vary in use. This will then enable a single system to be used in a much wider variety of situations, and also ensures that in any given situation a degree of flexibility is available. However, rotational movement in a connector construction is generally to be avoided, as it can lead to rupture of the conductors, loss of integrity of an electromagnetic interference screen, and inadvertent disconnection of the connector parts.

The present invention is defined in the independent claims below, to which reference should now be made. Advantageous features of the invention are set forth in the appendant claims.

The invention will be described by way of example with reference to the drawings, in which.

Figure 1:
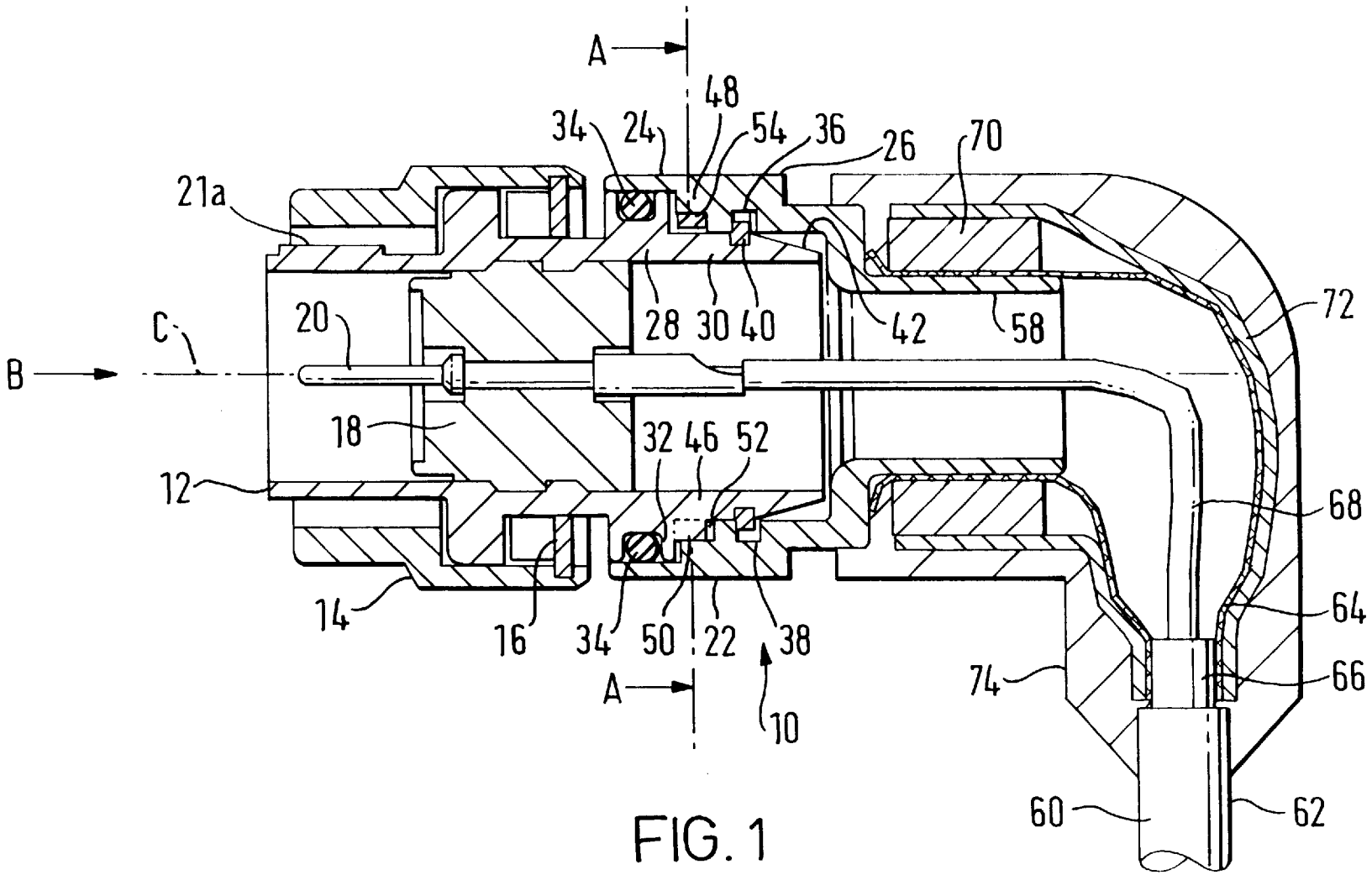
FIG. 1 is a longitudinal sectional view through a first connector and cable termination system embodying the invention.
Figure 3:
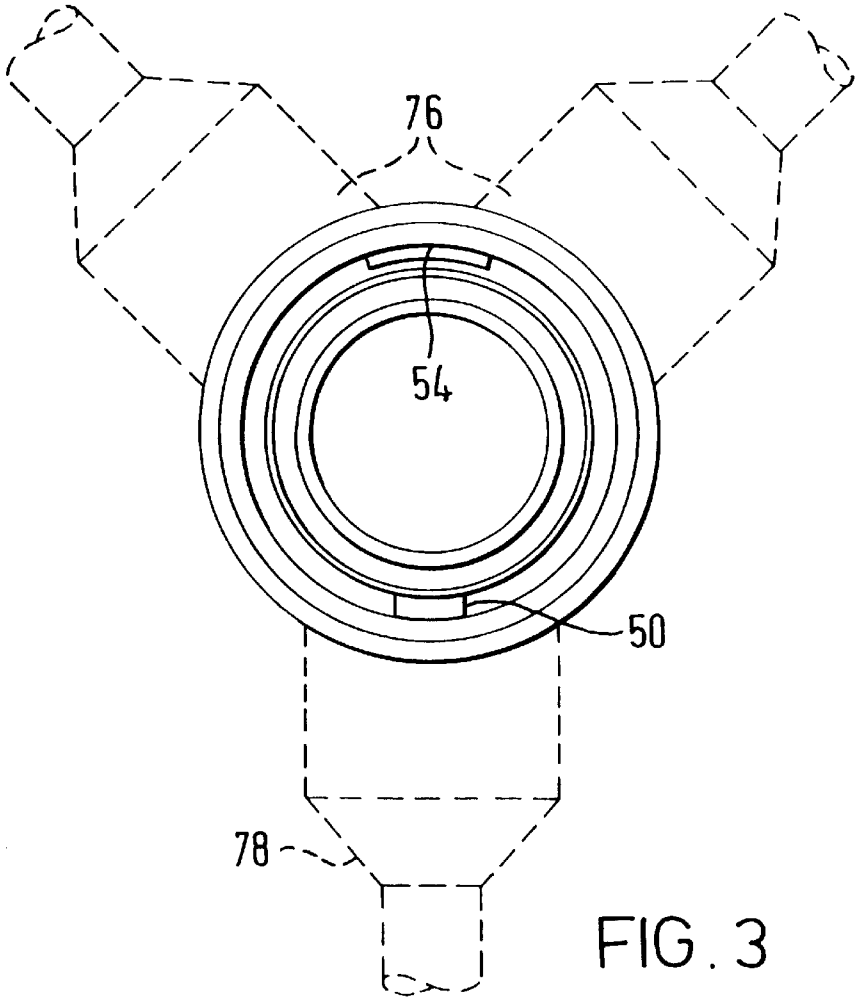
FIG. 3 is a section through the connector and cable termination system of FIG. 1 taken on the line A—A.
Figure 2:
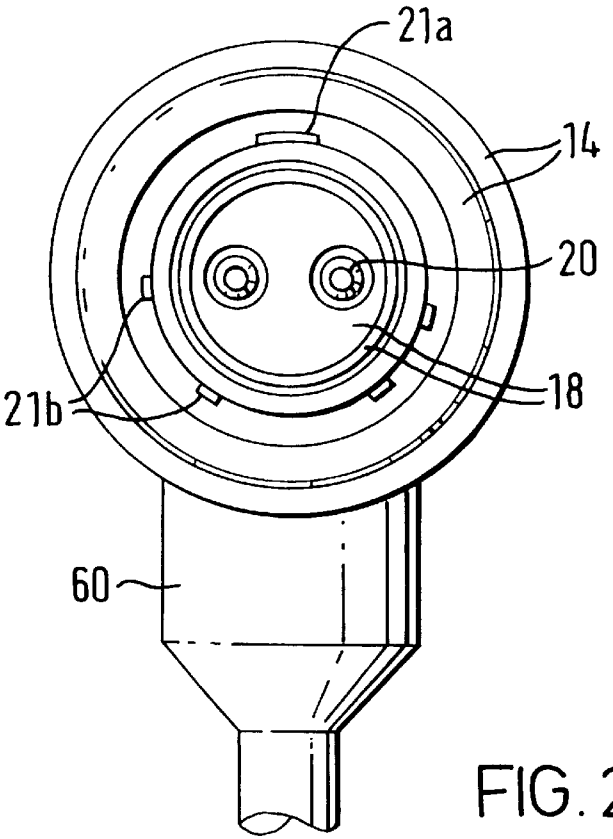
FIG. 2 is an end view taken on the arrow B in FIG. 1 of the connector and cable termination system of FIG. 1.

The connector and cable termination system embodying the invention and illustrated in FIGS. 1 to 3 is designed for a harsh environment and is for use with screened cables comprising one or more internal conductors, for example a so-called coaxial connector.

The connector and cable termination system 10 illustrated in FIG. 1 comprises a generally-cylindrical plug body 12 provided with a coupling ring 14 secured to it by a retaining ring 16. The plug body 12 contains an insulator 18 through which pass two (in this case) male connector pins 20. The connector pins 20 mate with female connector receptacles on a mating fixed connector (not shown). The lefthand or mating portion of the connector, comprising the coupling ring 14, insulator 18, and pins 20, and the lefthand portion of the plug body 12 are of conventional construction and are not, therefore, described in detail.

FIG. 2 is an end view of the connector taken in the direction of the arrow B in FIG. 2. FIG. 2 shows a number of keys 21 which ensure that the connector is only coupled to the correct mating connector, and is coupled to it with the correct orientation about the central longitudinal axis of the connector. To this end there are a single major key 21*a*, at the top as seen in FIG. 2, and four minor keys 21*b*, shown around the bottom half of the connector. The major key serves to indicate and ensure the correct orientation of the plug body in relation to the socket member of the mating connector, and the minor keys are differently positioned for different connectors, so that each connector can only mate with a mating connector which has correspondingly-located keyways.

The righthand or remote portion (as seen in FIG. 1) of the plug body 12 is surrounded by an outlet body 22. The outlet body 22 has a first portion 24 at the lefthand end as is seen in FIG. 1 of relatively larger diameter, a second portion 26 to the right as seen in FIG. 1 and which is of relatively smaller diameter, an intermediate portion 48 between the first portion 24 and the second portion 26, and a rear boss 58 which lies rearwardly of the second portion 26 (to the right in FIG. 1). The plug body 12 carries a relatively wider portion 28 which is opposed to the first portion 24 of the outlet body, and a relatively narrower portion 30 opposed to the second narrower portion 26 of the outlet body. The wider portion 28 of the plug body has a recess 32 for receiving a conductive resilient O-ring 34, which provides a degree of sealing between the plug body 12 and the outlet body 22. The narrower portions 30, 26 of the plug body and outlet body carry corresponding recesses 36, 38 which receive a retention ring 40. The righthand end of the plug body 12 is provided with a sloping cam surface 42.

To assemble the plug body into the outlet body, the retention ring 40 is first inserted into the recess 38 in the internal face of the outlet body 22, and the plug body 12 is then forced axially into the outlet body.

The retention ring 40 rides over the cam surface or taper 42 until it engages with the slot 36, thereby securing the plug body and the outlet body and inhibiting relative axial movement, while permitting rotational movement.

Between the wider portion and narrower portion of the plug body 12 and outlet body 22, is an intermediate portion comprising a portion 46 on the plug body of the same diameter as the narrower portion, but being provided with a key 50 which extends over a small circumferential extent. This is shown in FIG. 3. The intermediate portion 48 of the outlet body carries a recess 52 which permits the plug body 12 to rotate, with the key 50 riding in the recess 52, except for an inwardly-projecting detent 54 on the outlet body 22 at one location around the circumference of the is recess 50. The co-operation of the key 50 and detent 54 is such that the outlet body 22 and the plug body 12 can rotate relative to each other by an angle approaching but not exceeding 360° or one revolution. At least 180° of rotary movement will be provided, and preferably in excess of 270°.

The incoming cable 60 approaches the outlet body and the plug body at an angle, as shown an angle of 90°, to the major mating axis C of the connector. The incoming cable 60 is of a conventional type having an outer sheath 62, a tinned copper conducting braid 64, an insulative spacer 66, and a number of conductors 68. In this case there are two conductors 68. The conductors 68 are crimped or soldered to the ends of the respective connectors pins 20. The spacer 66 is cut off to the length shown. The braid 64 is led over the rear boss 58 on the outlet body 22, which, as shown, is of narrower diameter than the rest of the outlet body. A ferrule 70, diagrammatically shown, is crimped over the end portion of the braid 64 to secure it to the boss 58 of the outlet body, and ensure an electrical connection between the braid and the boss. Then a piece of heat-shrink tubing 72 is placed over the braid where it emerges from the outer sheath, and passes over the braid and the ferrule 70. It is heated to collapse it onto the braid and ferrule. Finally, the assembly is placed in a mould and a HYTREL over-moulding 74 is formed by injection moulding. HYTREL is a registered trade mark of E.I. du Pont de Nemours and Company. During this process, the heat-shrink tubing stops HYTREL from passing through the braid into the interior of the assembly. The over-moulding 74 acts as an environmental seal and also provides some strain relief. Alternative over-moulding materials include PVC or silicon rubber.

The braid 64 is clamped to the outlet body 22 by the ferrule 70 to provide a continuous ground path for electromagnetic compatibility (screening) purposes, but also provides strain relief for the cable. The O-ring 34 is made from a conductive material to form part of the electrical path from the plug body 12 to the braid 64.

In this way the cable is secured to the outlet body. The outlet body is however able to rotate over the plug body, thus allowing the cable to be led away from the assembly at any desired angle or orientation around the longitudinal axis C of the connector, as seen in the FIG. 2 direction. The amount of rotation is limited by the key 50 and detent 54, and the extreme positions 76 and the middle position 78 are indicated in outline in FIG. 3. Between the extreme positions, the user of the connector can rotate the cable assembly through a controlled angle relative to the major key 21*a* on the plug body. However, some resistance to rotation is provided by the O-ring 34, which is in compression between the plug body 12 and the outlet body 22. This resistance is preferably sufficient to prevent the outlet body from rotating under the weight of the cable so that it remains in the desired position.

The ability for the plug body and the cable to relatively rotate about the major mating axis C of the plug body enables users to modify the orientation of the cable assemblies embodying the invention in situ on their equipment. This is particularly useful when, as is commonly the case, the equipments vary from one to another. It avoids the need to have ready several different connector and cable termination systems for the different equipments.

Figure 4:
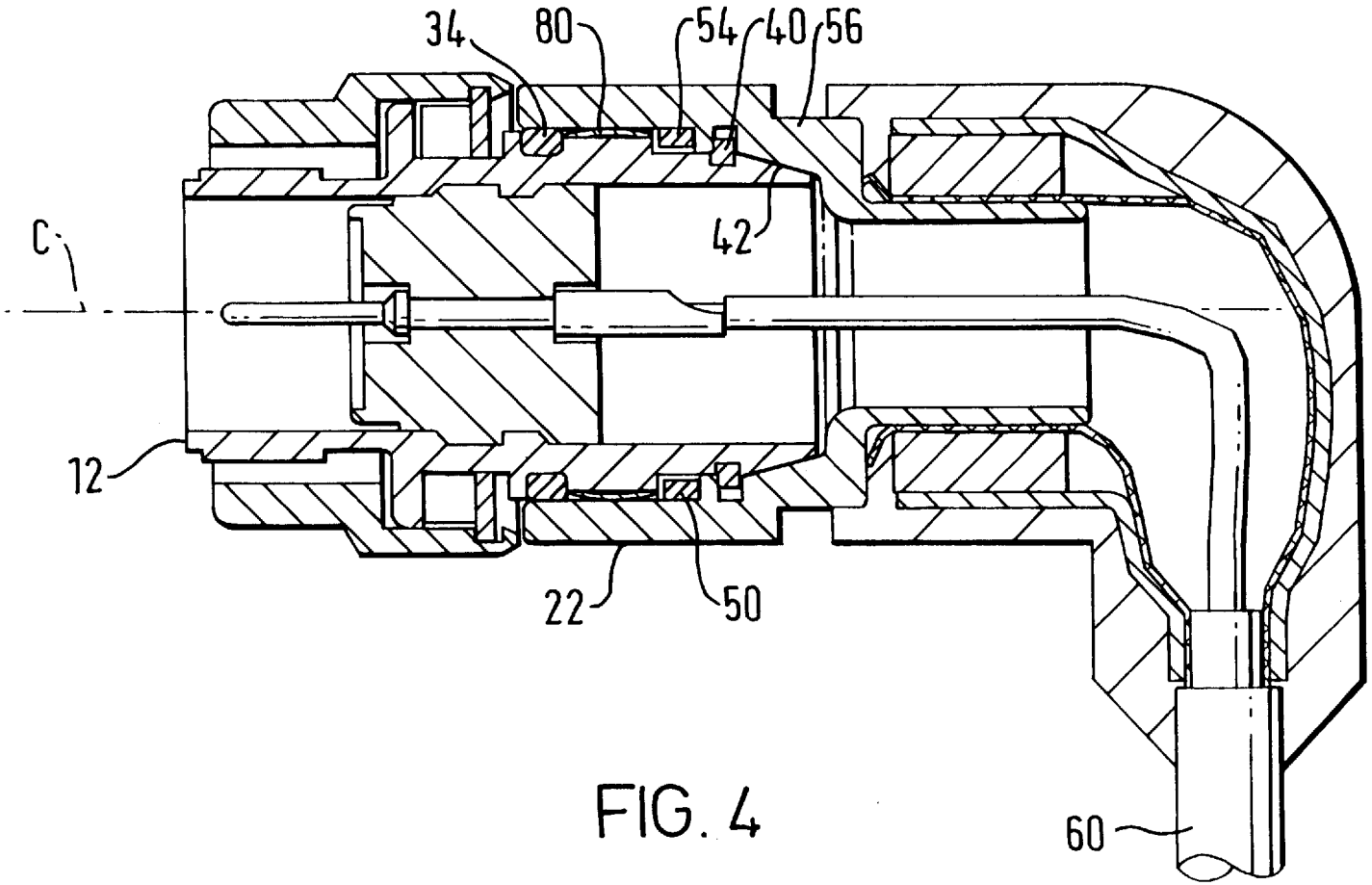
FIG. 4 is a view similar to FIG. 1 of a second connector and cable termination system embodying the invention.
Figure 5:
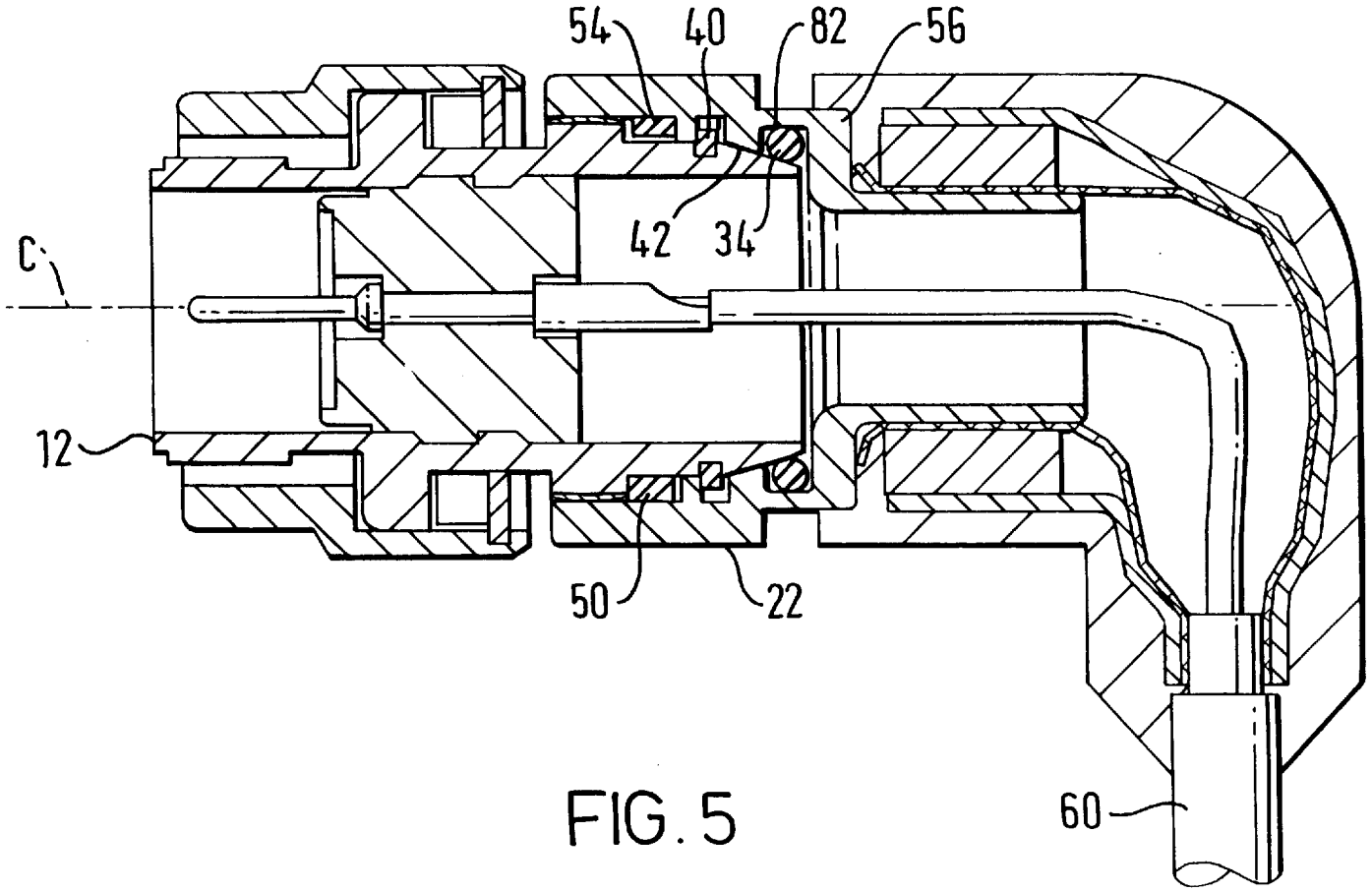
FIG. 5 is a view similar to FIG. 1 of a third connector and cable termination system embodying the invention.

Two modifications of the connector shown in FIG. 1 are shown in FIGS. 4 and 5 respectively. Referring first to FIG. 4, the second connector system embodying the invention shown in this figure is similar to the connector system of FIG. 1, except that a grounding spring 80 is included behind the O-ring. The grounding spring 80 is positioned around the wider portion of the plug body 12 adjacent the O-ring 34, and is in contact with the first portion 24 of the outlet body 22. The grounding spring provides surer electrical continuity between the braid and the plug body. The O-ring of this embodiment is nonconductive and does not now provide the electrical path between the outlet body and the plug body. The O-ring 34 again both provides a sealing function between the plug body and the outlet body, and provides limited frictional resistance to relative rotation of the outlet body and the plug body. It will be seen that the outlet body is shaped to conform closely to the shape of the plug body in the region 56 where it is opposed to the cam surface or taper 42. To compensate for the greater length of the connector required to accommodate the grounding spring as well as the O-ring, the coupling ring 14 is made shorter in length.

Referring now to FIG. 5, the third connector embodying the invention shown in this figure is similar to the connector system of FIG. 4, except that the O-ring 34 is in a different location. A grounding spring 80 is again included. The grounding spring 80 is, as in FIG. 4, positioned around the wider portion of the plug body 12 and is in contact with the first portion 24 of the outlet body 22. The grounding spring provides surer electrical continuity between the braid and the plug body. The O-ring 34 is now located in an annular recess 82 in the outlet body 22 opposed to the cam surface or taper 42, in fact in the region 56. The O-ring of this embodiment is non-conductive and does not provide the electrical path between the outlet body and the plug body. The O-ring 34 yet again both provides a sealing function between the plug body and the outlet body, and provides limited frictional resistance to relative rotation of the outlet body and the plug body. The arrangement of FIG. 5 has the advantage over FIG. 4 that it is not necessary to use a shortened coupling ring, as the length of the connector is not extended.

It is seen therefore that the order in which the various components can be located between the plug body and the outlet body can be changed. That is to say, the retention ring 40, key 50 and recess 52 limiting relative rotation, grounding spring 80, and O-ring 34 can be placed in a different order from those illustrated.

We claim:

1. An electrical connector and cable termination system comprising:

a first connector body part housing at least one conductive connector member, the first connector body part being adapted to mate with a second corresponding connector body part;

an outlet body mounted on the first connector body part;

a cable having a conductive screen which is fixedly attached to the outlet body, and at least one conductor inside the screen being fixedly connected to the at least one connector member, the cable approaching the outlet body at an angle to the major mating axis of the connector; and the outlet body and the first connector body part being arranged for relative rotation about the major mating axis of the connector, and having:

retention means for inhibiting relative axial movement of the outlet body and the first connector body part;

rotation-limiting engaging means on the outlet part and the first connector body part for permitting relative rotation by at least 180° but inhibiting relative rotation in excess of 360°; and an O-ring of resilient material between the outlet body and the first connector body part and adapted to provide a limited degree of frictional resistance to the relative rotation of the outlet body and the first connector body part.

2. An electrical connector and cable termination system according to claim 1, in which the retention means comprises a retention ring engageable in opposed recesses in the first connector body and the outlet body, and including a taper surface over which the retention ring slides during assembly of the outlet body to the plug body.

3. An electrical connector and cable termination system according to claim 1, in which the O-ring engages the taper surface.

4. An electrical connector and cable termination system according to claim 1, in which the O-ring is formed of conductive material.

5. An electrical connector and cable termination system according to claim 2, in which the O-ring is formed of conductive material.

6. An electrical connector and cable termination system according to claim 3, in which the O-ring is formed of conductive material.

7. An electrical connector and cable termination system according to claim 1, further comprising a grounding spring located between the first connector part and the outlet body.

8. An electrical connector and cable termination system according to claim 2, further comprising a grounding spring located between the first connector part and the outlet body.

9. An electrical connector and cable termination system according to claim 4, further comprising a grounding spring located between the first connector part and the outlet body.

* * * * *

UNITED STATES PATENT AND TRADEMARK OFFICE

CERTIFICATE OF CORRECTION

PATENT NO. : 5,882,226
DATED : March 16, 1999
INVENTOR(S) : Bell et al.

It is certified that error appears in the above-identified patent and that said Letters Patent is hereby corrected as shown below:

Title page,
Item [56], line 3, change "Warth" to -- Werth --;

Column 1,
Line 36, after "FIG. 1", change "." to -- ; --.

Column 3,
Line 39, change "in situ" to -- *in situ* --.

Column 4,
Line 42, change "the" (first occurrence) to -- a --.
Line 66, change "1" to -- 2 --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*